US006062446A

United States Patent [19]

Daneau

[11] Patent Number: 6,062,446

[45] **Date of Patent: *May 16, 2000**

[54] COMBINED BACKPACK, COT AND TENT

[75] Inventor: George Daneau, Derry, N.H.

[73] Assignees: Academy of Applied Science, Concord; Robert Dishman, Derry, both of N.H.; a part interest to each

[ * ] Notice: This patent is subject to a terminal disclaimer.

[21] Appl. No.: 08/170,491

[22] Filed: Dec. 20, 1993

Related U.S. Application Data

[63] Continuation of application No. 07/779,035, Oct. 18, 1991, abandoned.

[51] Int. Cl.[7] ..... A45F 4/04; A45F 4/06

[52] U.S. Cl. ..... 224/154; 224/153; 224/156; 5/111; 135/95

[58] Field of Search ..... 224/153, 154, 224/155, 156; 5/110, 111, 113, 114; 135/95

[56] References Cited

U.S. PATENT DOCUMENTS

| | | | |
|---|---|---|---|
| 1,464,875 | 8/1923 | Hull et al. | 224/154 X |
| 3,545,461 | 12/1970 | Carlson | 224/154 X |
| 3,601,825 | 8/1971 | Moorhead | 5/113 X |
| 3,619,827 | 11/1971 | Mackenzie | 224/154 X |
| 3,757,360 | 9/1973 | Wescott | 224/154 X |
| 3,886,609 | 6/1975 | Mackenzie | 5/110 |
| 3,912,138 | 10/1975 | Paua | 224/154 |
| 3,971,495 | 7/1976 | Velazquez | 224/154 |
| 4,234,005 | 11/1980 | Taylor | 224/154 X |
| 4,392,598 | 7/1983 | Dixon | 224/156 X |
| 4,883,206 | 11/1989 | Miller | 224/154 X |
| 4,885,812 | 12/1989 | Lindner | 5/113 |
| 4,914,768 | 4/1990 | Howard | 5/113 |
| 4,947,498 | 8/1990 | Van Boxtel | 5/114 X |
| 4,955,517 | 9/1990 | Maresca | 224/156 |
| 5,018,227 | 5/1991 | Canfield | 5/111 X |

FOREIGN PATENT DOCUMENTS

| | | | |
|---|---|---|---|
| 1536401 | 12/1978 | United Kingdom | 224/154 |

*Primary Examiner*—Gregory M. Vidovich
*Attorney, Agent, or Firm*—Rines and Rines

[57] ABSTRACT

This invention is a simplified combination backpack, cot and tent formed and integrated around a lightweight hinged metal frame which unfolds at hinge to form cot and internal tent frame structure. The tent, with draft skirt stored within the two halves of the folded frame, is then erected for shelter protection. After the frame is unfolded, the backpack will be suspended from the underside of the cot, off the ground and accessible from inside the tent through the cot fabric by means of a zipper.

2 Claims, 4 Drawing Sheets

COMBINED BACKPACK, COT AND TENT

The present invention relates to combination backpack-cot-tent assemblies and the like. This is a continuation application of parent application Ser. No. 07/779,035, filed Oct. 18, 1991, now abandoned.

BACKGROUND OF INVENTION

Throughout the years, numerous proposals have been advanced for providing the sportsman, outdoor-hiker or camper, military and similar users with a multi-function cot and protective covering or tent that can, in collapsed form, be carried on the back, assembled for use, and then repacked for further carrying.

While features of light weight, compactness and simple assembly have long been sought, the prior art approaches have involved serious disadvantages which the present invention admirably overcomes.

In U.S. Pat. No. 1,464,875, for example, a combination tent, hammock and pack sack is disclosed wherein the pack sack material itself converts into the hammock, the tent material is separate and carried in the pack sack, limiting the available backpack space, and a plurality of loose fixtures and components is required for a rather complicated assembly, and with the requirement of external guy wires and stakes for support. The system of U.S. Pat. No. 3,619,827 proposes to store the tent material within the cot frame, but again requires loose and telescoping frame sections for assembly, and also requires guy ropes for stability. In U.S. Pat. No. 3,757,360, a portable foldable cot frame may be hand or back carried, with tent fabric carried externally in a separate backpack, and the metal parts bearing against the user's back when so carried. While the pack frame-bed of U.S. Pat. No. 3,971,495 avoids some of the metal part abrasion against the back, the bed and cover material are carried within the pack, destroying its carrying space for other products, and the front and rear parts of the pack serve as the front and rear supports of the tent and bed. A combination light weight pack frame (for a separate backpack)-cot-and tent support is shown in U.S. Pat. No. 4,234,005, as another example, wherein one frame section is provided for carrying the separate pack, tent material and cot material, and a second hinged frame opens to form the cot support.

The present invention is directed to obviating the complexity of these prior systems, their separate parts, their lack of incorporation of the complete unincumbered-space backpack, cot and tent in a single assembly, and the need for external guy or other supports or external tent support systems.

OBJECT OF INVENTION

The object of the invention, thus, is to provide a new and improved combined backpack, cot and tent that is not subject to any of these disadvantages and limitations and that, to the contrary, provides for a single self-contained assembly that leaves the back pack space free for storage of other articles and that simply and easily unfolds with minimum assembly, no separate parts, and no requirement for external support components.

Other and further objects will be explained hereinafter and are more particluarly pointed out in the appended claims.

SUMMARY OF THE INVENTION

In summary, the invention relates to combination backpack, cot and tent utilizing a lightweight tubular metal frame with fabric affixed. The multi-purpose frame structure serves as backpack frame and housing for tent, tent supports, tent skirting and cot fabric when in the folded configuration. When unfolded, the frame forms cot support, cot sides and ends, base for tent supports and internal tent frame structure. This frame structure eliminates the need for support ropes, stakes or other external tent support components. The backpack frame does not contact the body of the user which allows for maximum comfort during extended use in the folded carry mode. Incorporation of cot with tent allows for maximum comfort in unfolded configuration, limits disturbances by insects, snakes, related pests and provides a dry foundation during wet weather. This unit is extremely versatile and completely self-contained. It does not require attachment of loose parts to assemble but simply unfolds and repositions existing components. The tent fabric may be detached all or in part to afford better ventilation during hot weather use and all fabric may be detached from frame structure to allow for cleaning.

BRIEF DESCRIPTION OF THE DRAWINGS

The invention will now be described with reference to the accompanying drawings in which.

DETAILED DESCRIPTION OF PREFERRED EMBODIMENT

Figure 1:
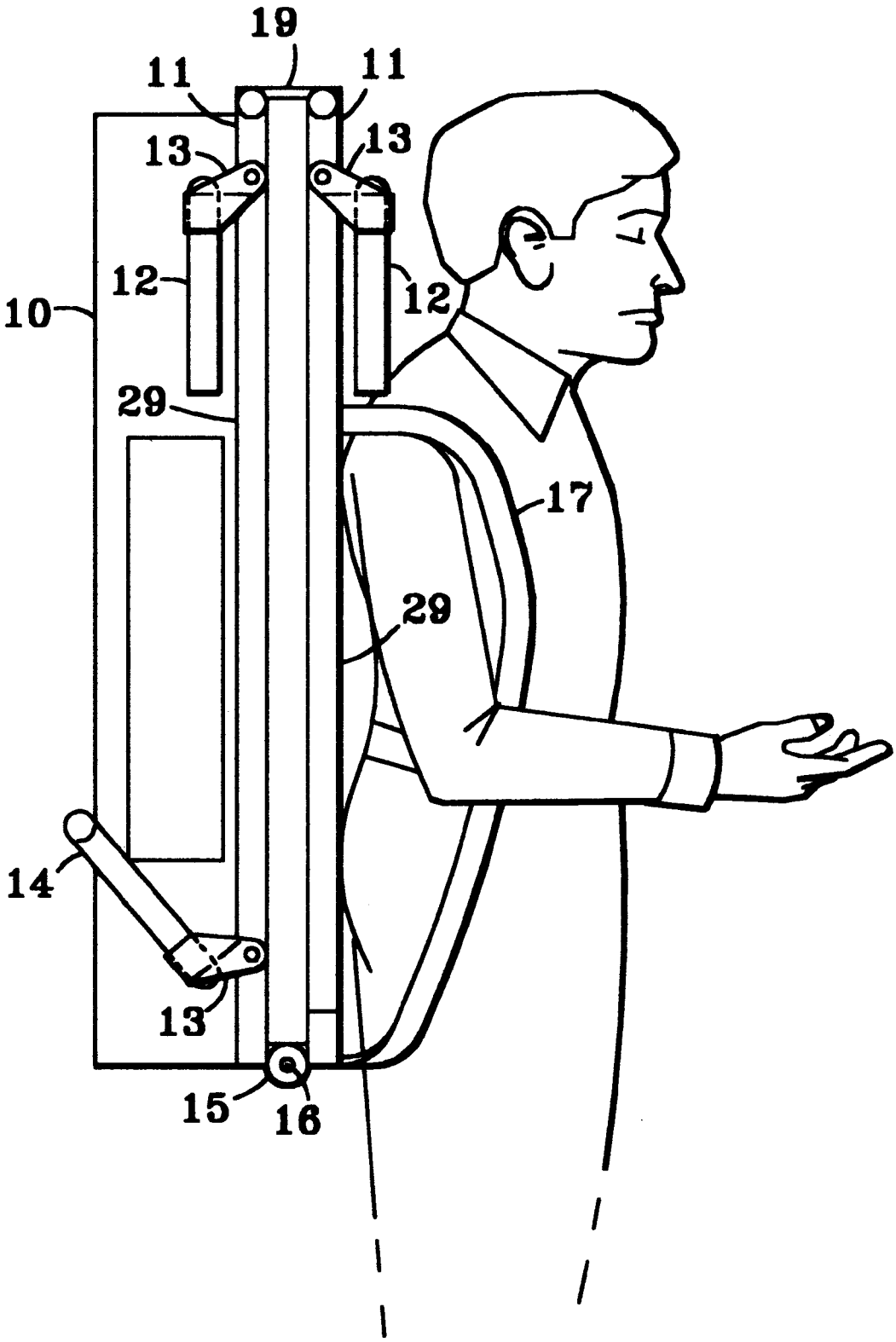
FIG. 1 shows the backpack assembly which I have termed "Tripak", illustrating the principles of the invention as worn by a user in preferred and best mode form.

Referring now specifically to the drawings which illustrate the Tripack in all stages of its user mode, FIG. 1 illustrates the unit in its user carrying mode. The backpack 10 which is conventional in concept forms an integral function as it shares portions of the fabric used to construct cot 27. Backpack 10, cot material 27 and tent material 23 are totally detachable from the frame 11 by the use of a hook and loop fastening strips 29. FIG. 1 further shows the folded legs 12 of which there are four, each mounted on the outer corners of the frame 11. The folding brackets 13 are held to the frame 11 by means of a common fastener such as a rivet. To prevent internal load pressure a center leg/stretcher 14 which has a U shape, more particularly shown in FIGS. 4 and 5, has been utilized. The center leg/stretcher 14 is attached on both sides of the frame using the same folding leg brackets 13 as previously used on corner legs 12. The center leg/stretcher 14 is designed to fold up against the backpack 10 which is attached with the hook and loop fastening strips 29 indicated earlier and user extensively throughout the unit.

Figure 2:
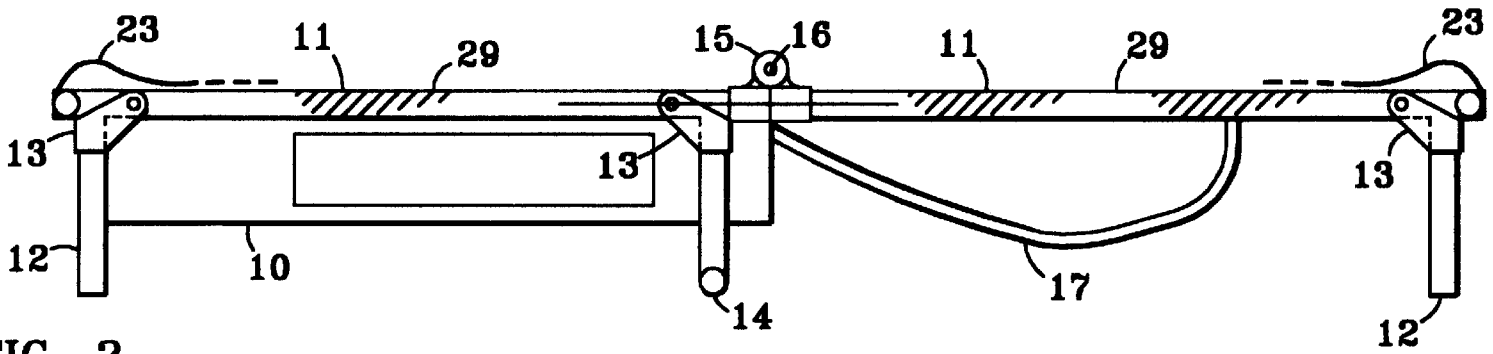
FIG. 2 shows the cot frame unfolded and with the legs unfolded in the backpack storage mode.
Figure 6A:
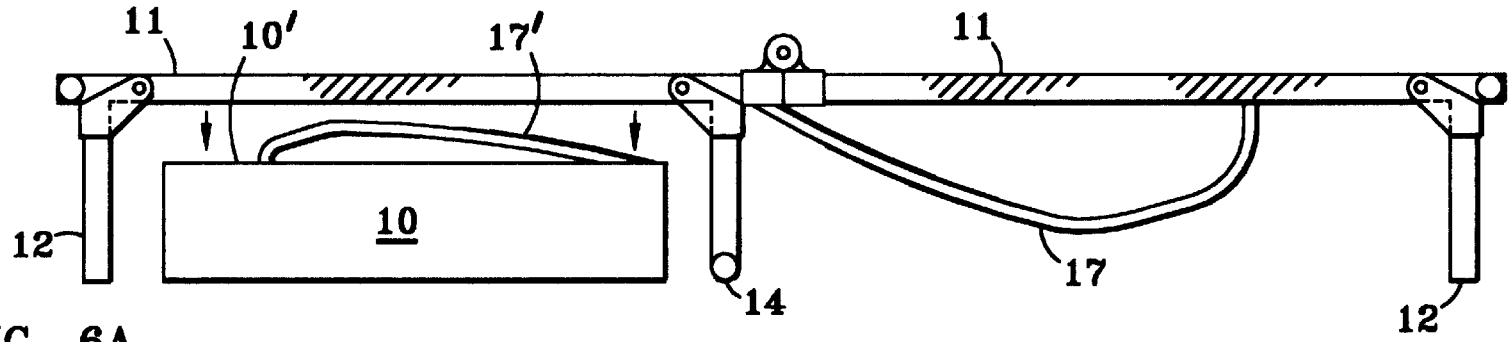
FIGS. 6A and 6B show similar views of a modification wherein the backpack may be provided with a back surface, still accessible through zippered openings in the cot and detachably carried by its own harness support.
Figure 6B:
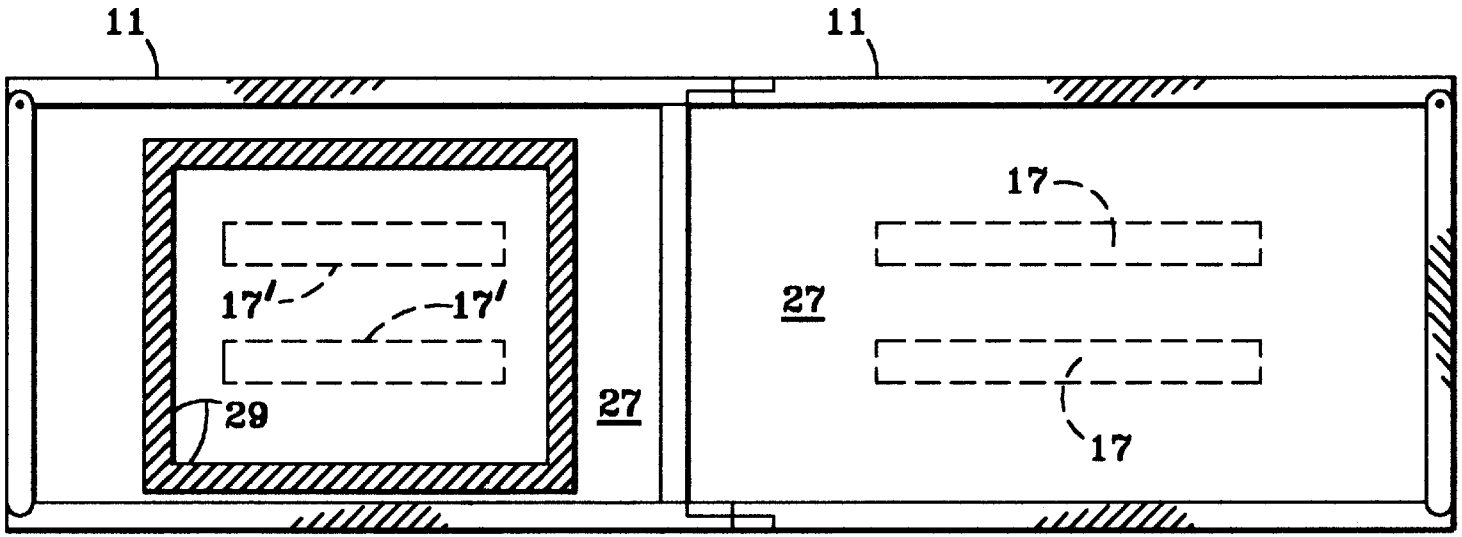

FIG. 2 shows the unit in the unfolded position in a side view. Backpack 10 is now in the storage mode, the four corner legs 12 are now unfolded and center leg/stretcher 14 is unfolded to allow a person to sleep on the cot 27. The leg brackets 13 are now in the locked position for stability as well as the center leg/stretcher 14. The shoulder harness assembly 17 is illustrated to show storage position. The frame hinge 15 is now more clearly shown for its secondary design feature of supporting the center tent supports 21 as shown in more details in FIG. 6 by using the center tent support socket 16.

Figure 3:
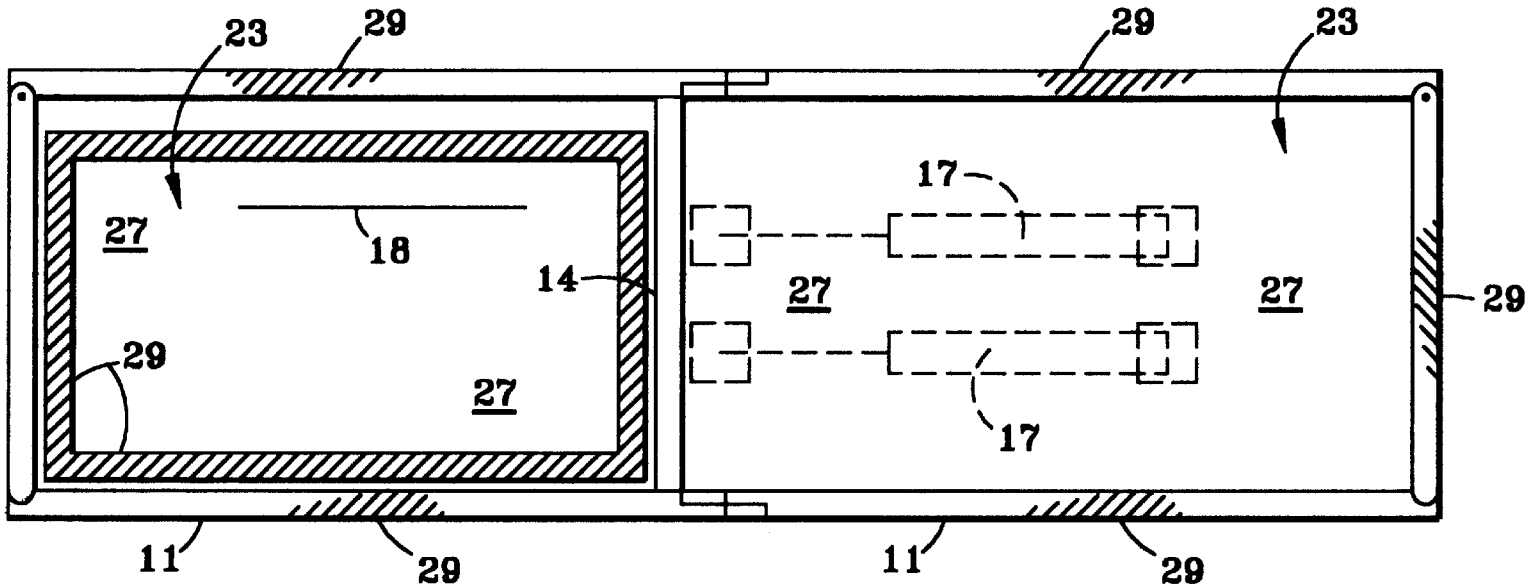
FIG. 3 shows the top view of FIG. 2.
Figure 4:
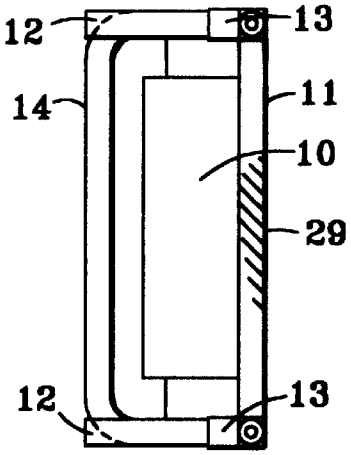
FIG. 4 is an end view of FIG. 2.

FIG. 3 shows a top view of the unfolded cot 27 with shoulder harness 17 as dashed lines for reference. The U shaped center leg/stretcher 14 is shown for relationship to the frame 11 and its rigidity. The cot material 27 is all one piece extending over the length and sides of the frame 11. This again is attached by means of the hook and loop fastening strips 29 and is detachable for the purpose of cleaning. Portions of the left side of the cot material 27 in FIG. 3, as previously mentioned, form the inner back of the backpack 10. A zipper 18 extending along and adjacent a side of the cot material 27 allows for accessibility to the backpack 10 while the user is on the cot 27 with the tent 23 assembled. An end view is shown in FIG. 4 looking from left to right showing the frame 11, backpack 10, unfolded legs 12 with their folding leg brackets 13 and the U shaped center leg/stretcher 14.

Figure 5:
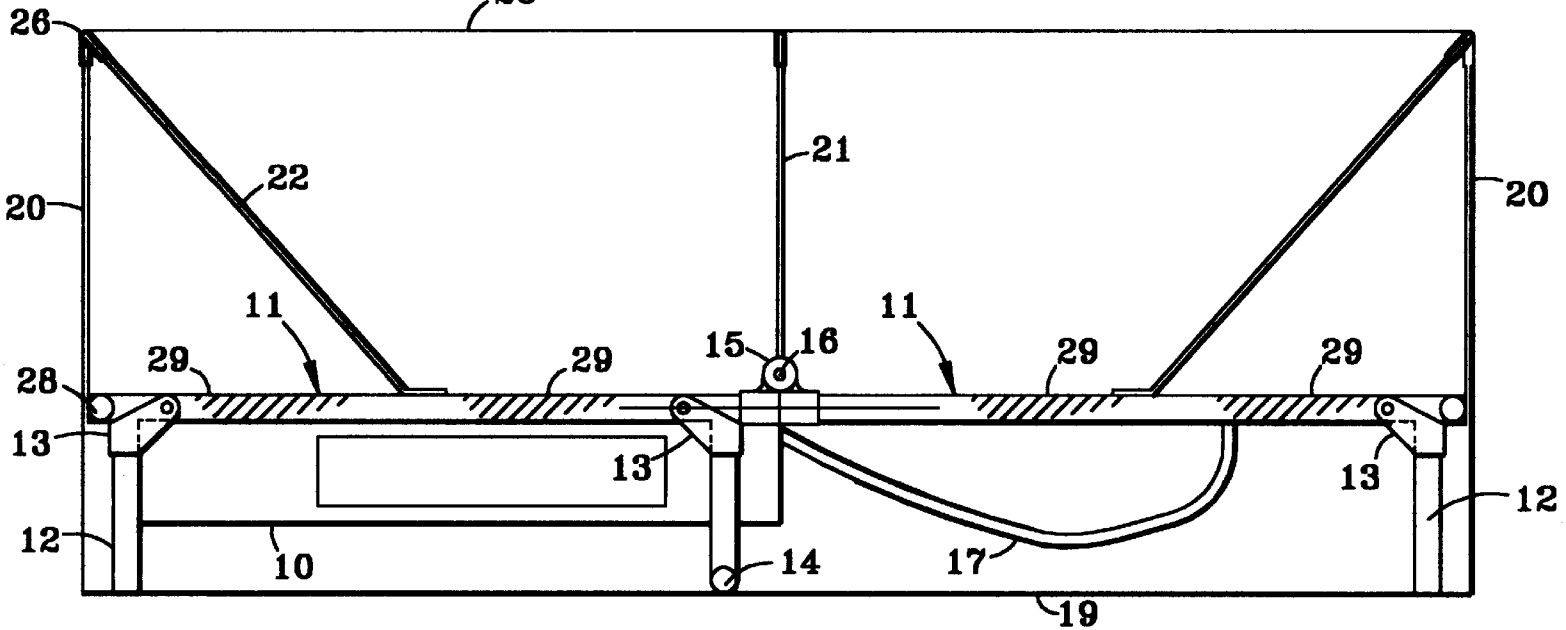
FIG. 5 shows the opended frame with the tent folded over on itself for an inner view of the cot, tent and supports.

In FIG. 5, the end tent support braces 22 are shown with end tent supports 20. These are steel rods permanently attached at an end to the frame 11 by the later-described bushings 28 for the purpose of erecting and supporting the tent 23. There are four end tent support braces 22 and four end tent supports 20 which are mated together using vinyl tubing connectors 26 at the apex of the tent 23. Each end tent support brace 22 and end tent support 20 makes a mated pair using two pairs of supports on either end of tent 23. These mated pairs of supports are fastened to frame 11 on one end of the end tent support 20 using a bushing 28 recessed in the tubular frame 11. The opposite end of the end tent support 20 is fastened with a vinyl tubing connector 26 to and tent support brace 22 on the end. The other end of the end tent support brace 22 is attached to the side of frame 11. Hook and loop fastenting strips 29 are provided. Each mated pair of braces 22 and 20 folds down flat against the frame 11 disassembled.

The raised view of tent 23 as shown in FIG. 5 illustrates a side view of the opened and assembled cot 27 and tent 23. One half of the tent 23 has been folded over on itself to show an inner view of the end tent support braces 22 and their relative positioning on the frame 11. The two center tent supports 21 are also shown and are fastened at the apex of the tent 23 using the vinyl tubing connector 26. They are attached at the frame hinge 15 on one side permanently affixed and on the other end detachable for the purpose of laying flat against the frame 11 during disassembly. The draft skirt 19 and tent 23 are one piece, attached in both the disassembled and assembled positions to the cot material 27 using the hook and loop fastening strips 29 for ease of assembly, being removable for cleaning purposes.

Thus, a single self-contained assembly is provided that leaves the backpack space free, for storage of other articles, and that simply and easily unfolds with minimum assembly, no separate parts, and no requirements for external s support components.

While the backpack 10 can be detached from the cot material 27 as for cleaning, as before explained, it is not provided with its own back closing surface. If it is desired to provide a totally self-contained backpack with a rear enclosing surface, such may be accomplished without an opening 18 at 10', FIG. 6A, where such a backpack is detachably held by a further harness 17', FIGS. 6A and 6B. Tent end flaps and mosquito netting are incorporated for accessibility and ventilation.

Further modifications will occur to those skilled in this art and such are considered to fall within the spirit and scope of the invention as defined in the appended claims.

What is claimed is:

1. A combined backpack, cot and tent assembly, portable on a user's back and formed and integrated in combination with a lightweight rectangular metal frame immediately transversely hinged to open from a carrying mode into a cot having cot surface material and internal tent frame structure having tent surface material for a usage mode, with the cot surface material being connected with and extending about the metal frame and the tent surface material also being connected with the metal frame and lying over the cot surface material; the assembly, in carrying mode, being folded to juxtapose the cot surface material of one half of the folded frame to be adapted to be held against the user's back with said backpack itself; being totally detachably carried on the other half of the folded frame; the assembly, in usage mode, being unfolded to form the cot with legs extendably connected to the frame, tent support means connected at one end thereof to the metal frame and elevatable to lift the tent surface material and hold the same in an elevated position above the unfolded cot; the cot surface material on said other half of the metal frame having an opening intermediate the cot surface material openable to expose the backpack therebelow and its contents to the user and in which the tent support means are provided with support braces having upper and lower ends, and connected at their upper ends with the tent support means and securable at their lower ends to the frame.

2. An assembly as claimed in claim 1 and in which said opening extends along and adjacent a side of the cot material for accessibility to the backpack contents while the user is on the cot.

* * * * *